US005497749A

United States Patent [19]

Kim

[11] Patent Number: 5,497,749

[45] Date of Patent: Mar. 12, 1996

[54] METHOD FOR CONTROLLING ENGINE IGNITION

[75] Inventor: Chang-Rae Kim, Seoul, Rep. of Korea

[73] Assignee: Hyundai Motor Co., Seoul, Rep. of Korea

[21] Appl. No.: 367,866

[22] Filed: Jan. 3, 1995

[30] Foreign Application Priority Data

Dec. 31, 1993 [KR] Rep. of Korea ..... 93-32029

[51] Int. Cl.[6] ..... F02P 5/145

[52] U.S. Cl. ..... 123/416

[58] Field of Search ..... 123/415, 416, 123/417, 424, 609, 612, 614, 617, 418

[56] References Cited

U.S. PATENT DOCUMENTS

| | | | |
|---|---|---|---|
| 4,584,978 | 4/1986 | Sasaki et al. | 123/416 |
| 4,643,150 | 2/1987 | Miura et al. | 123/418 |
| 4,665,884 | 5/1987 | Yoshida et al. | 123/416 |
| 4,700,305 | 10/1987 | Lotterbach et al. | 123/416 |
| 4,831,318 | 5/1989 | Yuasa et al. | 123/416 |
| 5,103,788 | 4/1992 | Araki | 123/416 |
| 5,131,367 | 7/1992 | Aoki et al. | 123/416 |
| 5,437,254 | 8/1995 | Korenaga et al. | 123/416 |

*Primary Examiner*—Willis R. Wolfe
*Attorney, Agent, or Firm*—Birch, Stewart, Kolasch & Birch

[57] ABSTRACT

A method for controlling engine ignition for use in a engine system wherein the engine system includes a plurality of cylinders and a crank shaft coupled to the cylinders, comprises the steps of: detecting a rotation angle of the crank shaft to thereby generate crank angle pulses, generating a cylinder pulse for identifying each of the cylinders, detecting the rising edge and the falling edge of each of the cylinder pulses to identify each of the cylinders, initializing the counting of the number of crank angle pulses, determining an ignition timing for each of the cylinders to thereby obtain an integer part and a decimal part thereof, comparing the integer portion with the number of crank angle pulses, converting the decimal portion into an ignition time; and generating an ignition signal at the ignition time when the number of crank angle pulses coincides with the integer part.

1 Claim, 4 Drawing Sheets

METHOD FOR CONTROLLING ENGINE IGNITION

FIELD OF THE INVENTION

The present invention relates to a method for controlling engine ignition; and, more particularly to a method for detecting an optimal ignition time of an automobile engine.

BACKGROUND OF THE INVENTION

An engine ignition system is installed in an automobile to control ignition related functions with a view to improving the engine performance. Ideally, the engine ignition system, under any driving condition, should be able to generate instantaneously a sufficient amount of ignition energy to ignite the engine. In timing the ignition, the crank angle plays an important role, as will be more fully described with reference to FIG. 1.

There is illustrated in FIG. 1 a schematic diagram of a conventional engine ignition system 10 comprising a crank angle detection sensor 1, an electronic control unit (ECU) 2, a transistor 3, and an ignition coil assembly 4. The ignition coil assembly 4 further includes a primary and a secondary coils, 4*a*, 4*b*, which are set up to allow a battery's electrical power to be inputted thereto. The primary coil 4*a* is connected to a collector of the transistor 3, and the secondary coil 4*b*, to a spark plug(not shown).

The crank angle detection sensor 1 senses the crank angle and transmits a corresponding signal to the ECU 2. The ECU 2 outputs a turn-on signal to a base of the transistor 3 to thereby turn it on at a predetermined crank angle. Upon turning the transistor 3 on, electrical power from a battery flows through the primary coil 4*a* and the secondary coil 4*b*, resulting in a dwell-on state or period. The ECU 2 continuously monitors the crank angle, detected by the crank angle detection sensor 1, and outputs a turn-off signal at another predetermined crank angle which will, in turn, turn the transistor 3 off. When the transistor 3 is turned off, a high voltage is induced to the secondary coil 4*b* of the ignition coil assembly 4, generating a spark at the spark plug, thereby igniting the engine.

However, if the dwell-on state, during which the transistor 3 is turned on, is too short, then the engine does not properly ignite; on the other hand, if the dwell-on state is too long, then the ignition coil may be harmed, shortening its life time. In this connection, in a conventional engine ignition system, the duration of the dwell-on state as well as the ignition timing is controlled by using predetermined crank angles, resulting in the engine ignition timing to be always constant regardless of the condition of the engine or other driving conditions. This may lead to a "knocking" of the engine.

SUMMARY OF THE INVENTION

It is, therefore, a primary object of the present invention to provide an improved engine ignition control method capable of achieving an engine ignition at an optimal time.

In accordance with the present invention, there is provided a method for controlling engine ignition for use in a engine system, wherein the engine system includes a plurality of cylinders and a crank shaft coupled to the cylinders, comprising the steps of: detecting a rotation angle of the crank shaft to thereby generate crank angle pulses having a period of 360/N degrees with N being a positive integer; generating a cylinder pulse for identifying each of the cylinders, the cylinder pulse having a duration represented by an crank angle interval between a rising edge and a falling edge of the cylinder pulse, and the cylinder pulse duration for each of the cylinders being different; detecting the rising edge and the falling edge of each of the cylinder pulses to thereby identify the cylinder; initializing the counting of the number of crank angle pulses once the falling edge of each of the cylinder pulses is detected; determining an ignition timing for each of the cylinders in a unit of the period of the crank angle pulses to thereby obtain an integer portion and a decimal portion thereof; comparing the integer portion with the number of crank angle pulses; converting the decimal portion into an ignition time; and generating an ignition signal at the ignition time when the number of crank angle pulses coincides with the integer portion.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE PREFERRED EMBODIMENTS

Figure 1:
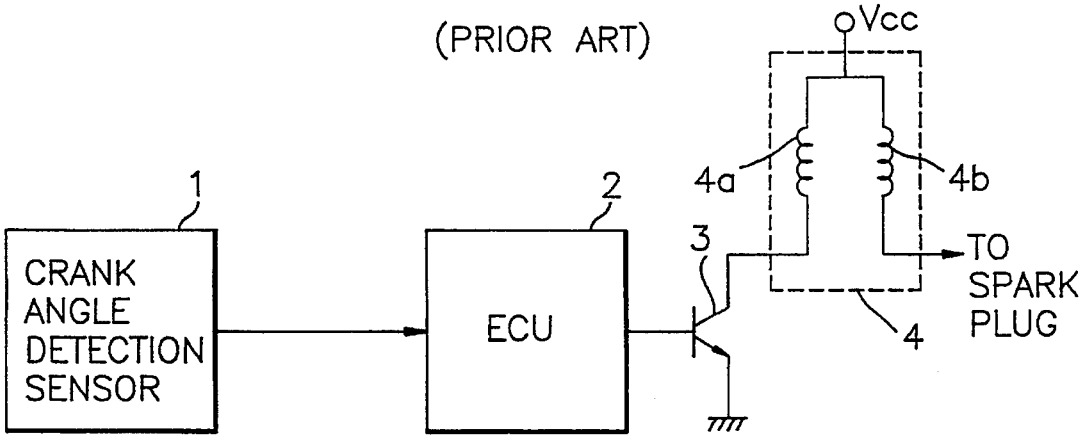
FIG. 1 (PRIOR ART)
FIG. 1 is a schematic diagram showing,a conventional engine ignition system.
Figure 2:
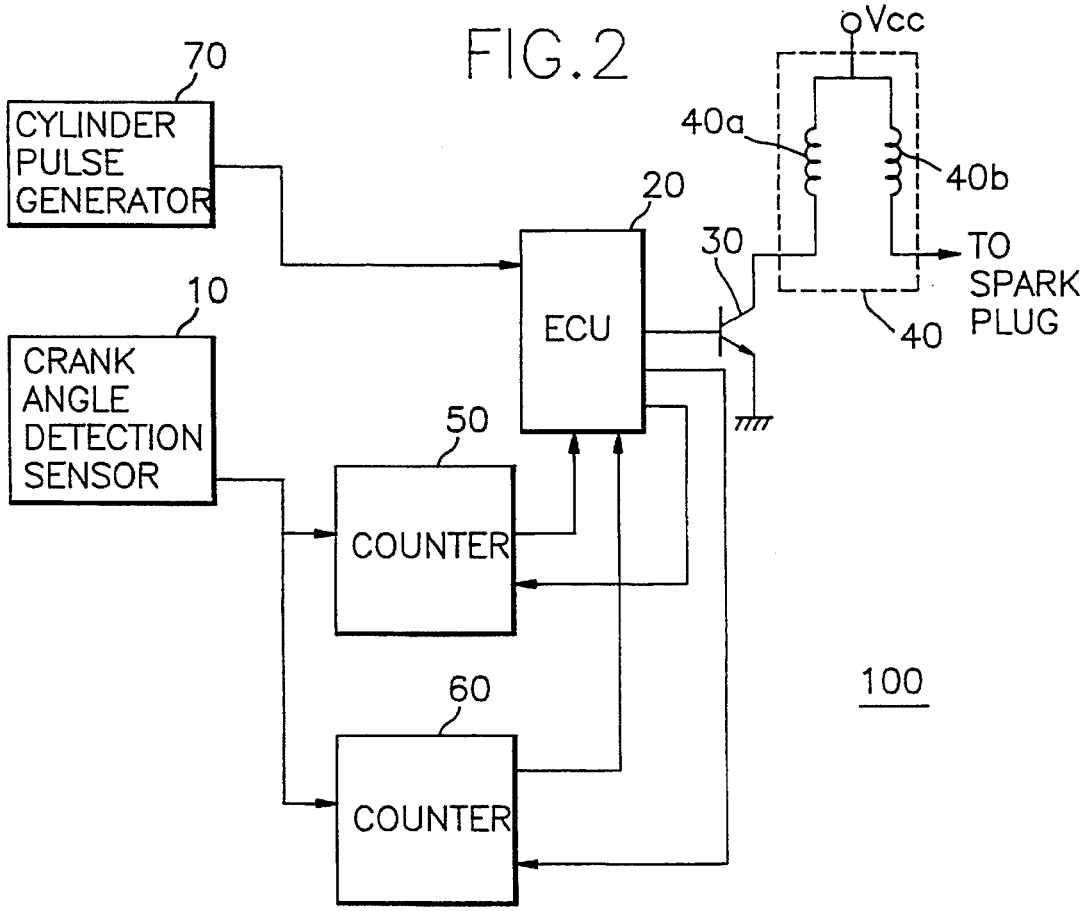
FIG. 2 presents a schematic diagram of an engine ignition system in accordance with a preferred embodiment of the present invention.
Figure 3:
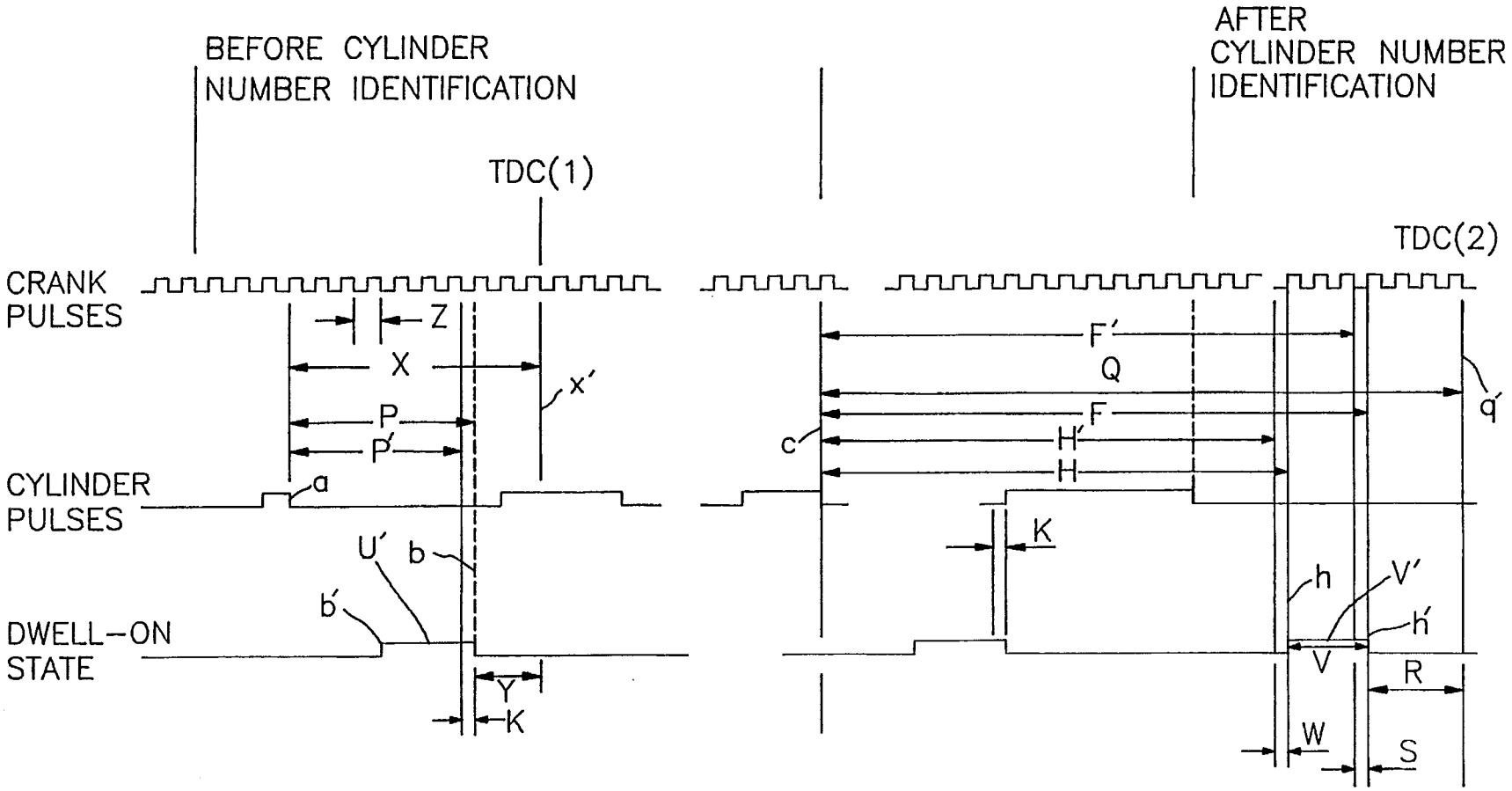
FIG. 3 provides timing charts of crank angle pulses, cylinder pulses and dwell-on state.

There is shown in FIG. 2 a schematic diagram of an engine ignition system 100 of the present invention for an engine which includes a plurality of, e.g., 4, cylinders and a crank shaft coupled to the cylinders. The engine ignition system 100 comprises a crank angle detection sensor 10, an electronic control unit (ECU) 20, a transistor 30, a pair of counters 50, 60, a cylinder pulse generator 70, and an ignition coil assembly 40 including a primary coil 40*a* and a secondary coil 40*b*, wherein the primary coil 40*a* is connected to a collector of the transistor 30, and the secondary coil 40*b* is connected to a spark plug (not shown). The crank angle detection sensor 10 detects the rotation of the crank shaft to provide corresponding crank angle pulses, e.g., 30 pulses for each 360° rotation of the crank shaft, each pulse corresponding to 12°, as shown in FIG. 3, to the pair of counters 50, 60. The pair of counters 50, 60 count the crank angle pulses and sends the count value to the ECU 20. The cylinder pulse generator 70 generates a characteristic cylinder pulse for each of the cylinders in that the duration of the cylinder pulse for a cylinder is different from those for other cylinders, as shown in FIG. 3, the duration being represented by an crank angle interval between a falling and a rising edges thereof. Since the duration of the cylinder pulses for a cylinder differs from cylinder pulse durations for other cylinders, this can be used to distinguish or identify each cylinder. The ECU 20, upon receiving the count value from the pair of counters 50, 60 and the characteristic cylinder pulses from the cylinder pulse generator 70, determines a dwell-on state, as will be explained later in detail, and outputs a turn-on signal at the onset of the dwell-on state, thereby turning the transistor 30 on. Upon turning the transistor 30 on, electrical power from a battery flows through the primary and secondary coils 40*a*, 40*b* of the ignition coil assembly 40. The ECU 20 continuously monitors the crank angle pulses, and outputs a turn-off signal at the offset of the dwell-on state which will, in turn, turn the transistor 30 off. When the transistor 30 is turned off, a high voltage is induced to the secondary coil 40*b* of the ignition coil assembly 40, generating a spark at the spark plug, to thereby ignite the engine.

If the engine is ignited during the occurrence of a cylinder pulse, the cylinder number cannot be identified, and hence, the optimal ignition time of the cylinder, since the onset of the cylinder pulse is not read by the ECU. In such a case, the pair of counters 50 and 60 is reset at the falling edge a of the cylinder pulse. When the count value of the crank angle pulses from the pair of counters reaches a predetermined value stored in the ECU 20, the ECU outputs a turn-on signal to the transistor 30 at b', thereby producing a dwell-on state U' as shown in FIG. 3. An angle P between the falling edge a of the cylinder pulse to an ignition point b, as shown in FIG. 3, is determined using the following equation:

$$P = [(X-Y)/Z]-1 \quad \text{Eq. (1)}$$
$$= P'+K$$

wherein P' is an integer portion of P; K, a decimal portion of P; X, an angle between the falling edge a of the cylinder pulse to a top dead center (TDC) for that cylinder, x', the TDC being the position of a piston at its highest point; Y, an angle between the TDC, x', and the falling edge of the dwell-on state or the ignition point, b; and Z, the angle between two successive falling edges of the crank angle pulses, i.e., a period of the crank angle pulses in a unit of angle. In Eq. (1), X, Y and Z are system related values, and therefore P, P' and K can be calculated and/or stored in the ECU 20. In Eq. (1), one is subtracted in order to account for various time delays. Furthermore, in case the angle P is not an integer, the decimal portion thereof, K, is converted into a unit of time using the following equation in order to improve the controlling accuracy:

$$M=(K*L)\ Z \quad \text{Eq. (2)}$$

wherein M is the converted time value of the decimal portion of the angle P; L, the period of one crank angle in a unit of time; K, the decimal portion of the angle P in degree; and Z, the angle between two successive falling edges of the crank angle pulses.

During the dwell-on state U', the count value from the pair of counters is compared with the integer portion P' of the angle P. If the count value is equal to P', then an internal timer in the ECU 20 is initialized.

The time on the internal timer is then compared with a first time constant $I_1$ obtained by adding M and a period of crank angle pulses in a unit of time, and subtracting therefrom the time delays. If the time on the internal timer and the first constant $I_1$ are equal, which denotes that the ignition point is considered to be attained, the ECU 20 provides the turn-off signal to the base of the transistor 30, causing the transistor 30 to be turned off. Accordingly, a high voltage is induced to the secondary coil 40*b*, generating a spark at the ignition plug, thereby igniting the engine.

On the other hand, if the cylinder number is identified, an angle H between the falling edge c of a prior cylinder pulse to the rising edge h of a dwell-on state V', as shown in FIG. 3, is determined using the following equation:

$$H = [(Q-R-v)/Z]-1 \quad \text{Eq. (3)}$$
$$= H'+W$$

wherein Q is the angle from the falling edge c of the prior cylinder pulse to the TDC, q'; R, the angle between the falling edge h' of the dwell-on state V' and the TDC, q'; V, the duration of the dwell-on state V'; Z, the angle between two successive falling edges; H', an integer portion of the angle H; and W, a decimal portion of the angle H. In Eq. (3), Q, R and V are system related values, and, therefore, H, H' and W can be calculated and/or stored in the ECU 20.

In Eq. (3), one is subtracted in order to account for various time delays. Furthermore, in case the angle H is not an integer, the decimal portion thereof is converted into a unit of time using the following equation in order to improve the controlling accuracy:

$$J=(W*T)/Z \quad \text{Eq. (4)}$$

wherein J is the converted time value of the decimal portion of the angle H; W, the decimal portion of the angle H in degree; T, the period of one crank angle in a unit of time; and Z, the angle between two successive falling edges of the crank angle pulses.

Prior to the comparing of the count value with the angle H or the integer portion thereof H', if the cylinder number is either 1 or 4, one of the pair of counters, e.g., 50, is reset while the remaining counter 60 continues to count. The reverse would be true if the cylinder number is determined to be either 2 or 3. When the count value from the counter that was reset reaches H', an internal timer in the ECU 20 is initialized.

The time on the internal timer is then compared with a second time constant $I_2$ obtained by adding J and a period of crank angle pulses converted in a unit of time, and subtracting therefrom the time delays. If the time on the internal timer and the second time constant $I_2$ are equal, then the ECU 20 outputs a turn-on signal to the transistor 30, thereby producing a dwell-on state.

An angle F between the falling edges c of the prior cylinder pulse to the falling edge h') of the dwell-on state V', i.e., the ignition timing, is determined using the following equation:

$$F = \frac{Q-R}{Z}-1 \quad \text{Eq. (5)}$$
$$= F'+S$$

wherein F' is an integer portion of the angle F; S, a decimal portion of the angle F; Q, the angle from the falling edge c of the prior cylinder pulse to the TDC, q'; R, the angle between the falling edge h' of the dwell-on state V' and the TDC, q'; and Z, the angle between two successive falling edges.

In Eq. (5), Q, R and Z are system related values, and, therefore, F, F' and S can be calculated and/or stored in the ECU 20. In Eq. (5), one is subtracted in order to account for various time delays. Furthermore, in case the angle F is not an integer, the decimal portion thereof S is converted into a unit or time using the following equation in order to improve the controlling accuracy:

$$N=(S*T)/Z \quad \text{Eq. (6)}$$

wherein N is the converted time value of the decimal portion of the angle F; T, the period of one crank angle in a unit of time; S, the decimal portion of the angle F in degree; and Z, the angle between two successive falling edges of the crank angle pulses.

During the dwell-on state V', the count value from one of the counters that was reset is compared with the integer portion F' of the angle F. If F' and the count value are equal, then an internal timer is initialized.

The time on the internal timer is then compared with a third time constant $I_3$ obtained by adding N and a period of crank angle pulses in a unit of time, and subtracting therefrom the time delays. If the time on the timer and the third time constant $I_3$ are equal, then the ignition point is considered to be attained, and the ECU 20 provides a turn-off signal to the base of the transistor 30, causing the transistor 30 to be turned off. Accordingly, a high voltage is induced to the secondary coil 40*b*, generating a spark at the ignition plug, thereby igniting the engine.

Figure 4A:
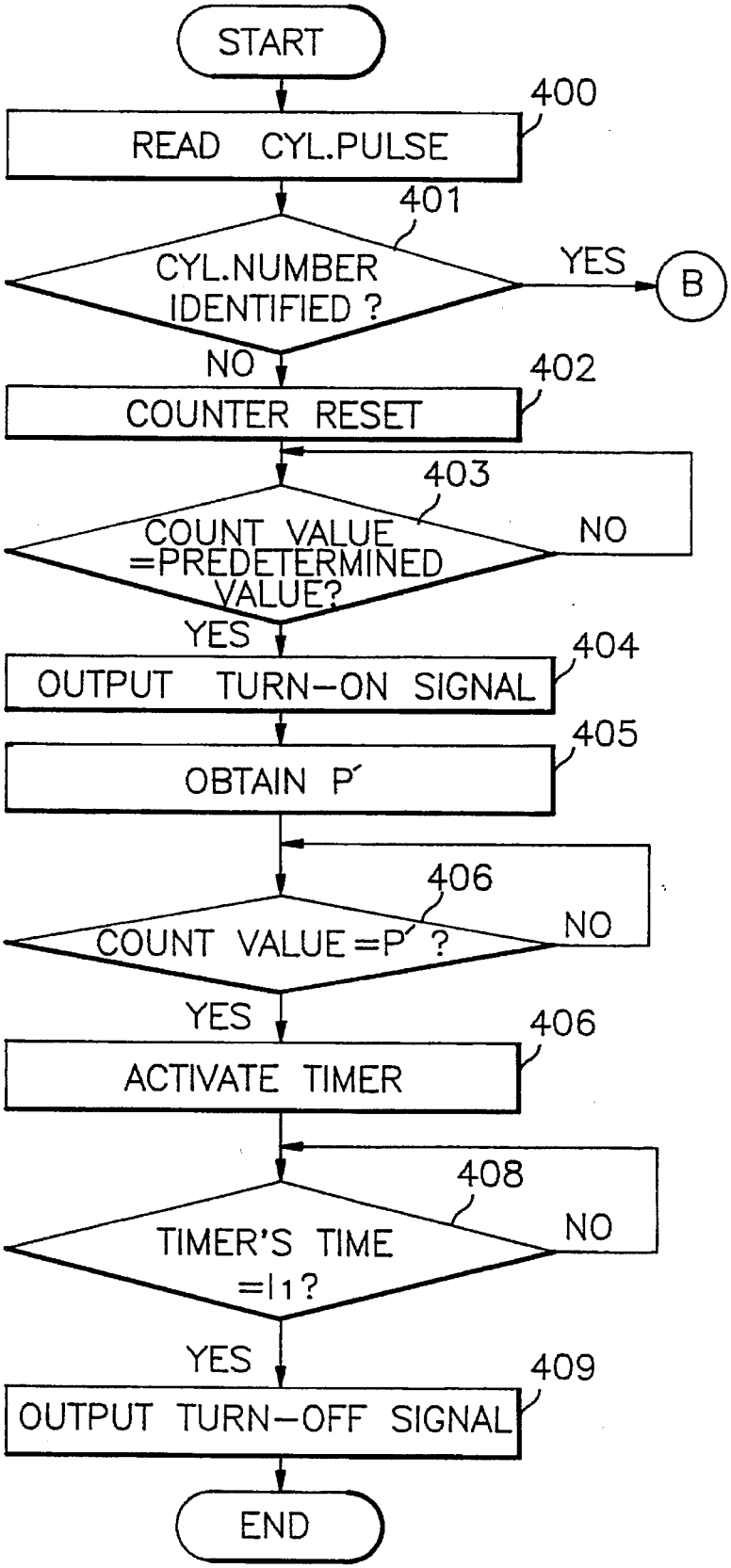
FIGS. 4A and 4B offer flow charts describing the execution steps of the inventive method operable under various conditions.
Figure 4B:
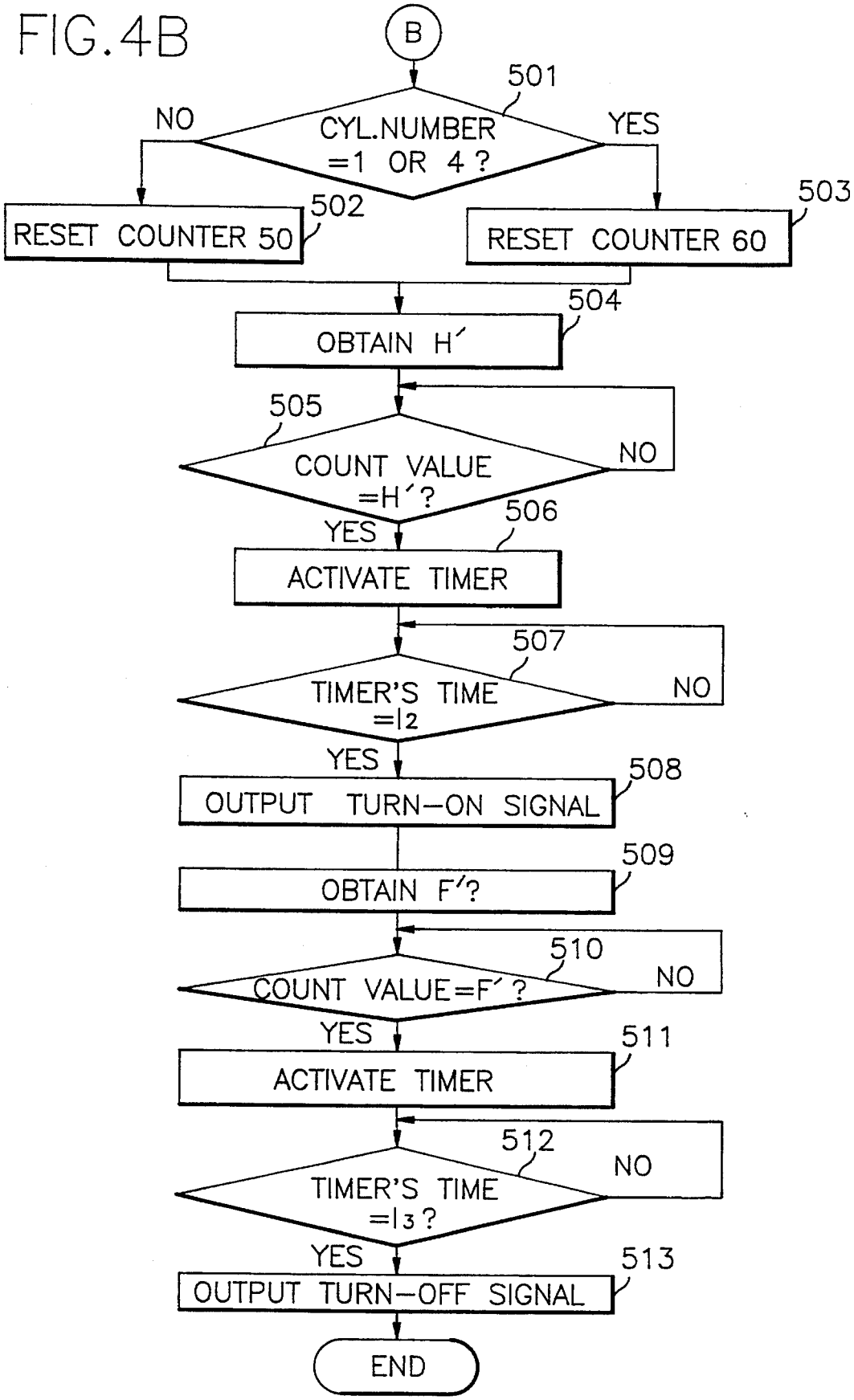

Determination of the optimal ignition time is carried out in accordance with the procedure depicted in FIG. 4. In step 400 of FIG. 4A, the falling and rising edges of the cylinder pulse are read by the ECU 20, with which the cylinder number is identified in step 401. If the cylinder number is identified in step 401, the procedure goes to step 501 in FIG. 4B; and, otherwise, the counters are reset at the falling edge of the cylinder pulse in step 402. The count value from the counters is compared with the predetermined value in step 403, and if the count value is not equal to, i.e., less than, the predetermined value, the step 403 is repeated until the count value becomes equal to the predetermined value; and if the count value is equal to the predetermined value, then the ECU 20 outputs a turn-on signal to the transistor 30 in step 404, thereby producing a dwell-on state.

In step 405, the integer portion P' of the angle P in Eq. (1) is calculated at or read from the ECU 20, and in step 406, the count value from the counters is compared with P'. If the count value is less than P', the step 406 is repeated until the count value becomes equal to P'; and if the count value is equal to P', then, in step 407, an internal timer is initialized. The time on the internal timer is compared with the first time constant $I_1$ in step 408 until they coincide, and if they are found to be equal, the ECU 20 outputs a turn-off signal to the transistor 30, thereby inducing a high voltage to the secondary coil 40*b* and igniting the engine.

If the cylinder number is identified in step 401, one of the pair of counters, 50 or 60, is reset in either step 502 or step 503, depending on the cylinder number. For example, if the cylinder number is determined as either 1 or 4 in step 501 as shown in FIG. 4B, the count 60 is reset in step 503; and if not, the counter 50 is reset in step 502. In step 504, the angle H' is calculated at or read from the ECU 20, and the count value from the counter reset in either step 502 or 503 is compared with H' in step 505. If the count value and H' are found to be equal in step 506, an internal timer in the ECU 20 is initialized in step 506. If not, the step 505 is repeated until the count value equals H'. In step 507, the time on the internal timer is compared with the second time constant $I_2$ until they coincide with each other. If they are found to be equal, then, in step 508, the ECU 20 outputs a turn-on signal to the transistor 30, thereby producing a dwell-on state.

In step 509, the angle F' is calculated at or read from the ECU 20. The count value from one of the counters reset in either step 502 or 503 is compared with F' in step 510. If they are found to be equal, the timer of the ECU 20 is initialized in step 511, and if not, step 510 is repeated until those two values become equal.

The time on the internal timer is compared with the third time constant $I_3$ in step 512 until they become equal. If those two values are equal, then the ECU 20 outputs a turn-off signal to the transistor 30 in step 513, thereby inducing a high voltage to the secondary coil 40*b*, generating a spark at the ignition plug, and igniting the engine. The procedure described in FIGS. 4A and 4B is repeated continuously as long as the engine runs.

While the present invention has been shown and described with reference to the particular embodiments, it will be apparent to those skilled in the art that many changes and modifications may be made without departing from the spirit and scope of the invention as defined in the appended claim.

What is claimed is:

1. A method for controlling engine ignition for use in a engine system wherein the engine system includes a plurality of cylinders and a crank shaft coupled to the cylinders, comprising the steps of:

detecting a rotation angle of the crank shaft to thereby generate crank angle pulses having a period of 360/N degrees with N being a positive integer;

generating a cylinder pulse for identifying each of the cylinders, the cylinder pulse having a duration represented by an crank angle interval between a rising edge and a falling edge of the cylinder pulse and the cylinder pulse duration for each of the cylinders being different;

detecting the rising edge and the falling edge of each of the cylinder pulses to identify each of the cylinders;

initializing the counting of the number of crank angle pulses, once the falling edge of each of the cylinder pulses is detected;

determining an ignition timing for each of the cylinders in a unit of the period of the crank angle pulses to thereby obtain an integer portion and a decimal portion thereof;

comparing the integer portion with the number of crank angle pulses;

converting the decimal portion into an ignition time; and generating an ignition signal at the ignition time when the number of crank angle pulses coincides with the integer portion.

* * * * *